US009378716B1

(12) United States Patent
Rieder

(10) Patent No.: US 9,378,716 B1
(45) Date of Patent: Jun. 28, 2016

(54) PERCUSSION INSTRUMENT

(71) Applicant: Axel Rieder, Turgi (CH)

(72) Inventor: Axel Rieder, Turgi (CH)

( * ) Notice: Subject to any disclaimer, the term of this patent is extended or adjusted under 35 U.S.C. 154(b) by 0 days.

(21) Appl. No.: 14/961,044

(22) Filed: Dec. 7, 2015

(30) Foreign Application Priority Data

Dec. 9, 2014 (EP) ..... 14196874

(51) Int. Cl.
*G10D 13/06* (2006.01)
*G10K 3/00* (2006.01)

(52) U.S. Cl.
CPC . *G10D 13/06* (2013.01); *G10K 3/00* (2013.01)

(58) Field of Classification Search
CPC ..... G01D 13/00; G01D 13/02; G10K 1/071; G10K 1/063; G10K 1/07; G10K 1/072; G10K 1/074; G10K 1/26; G10K 1/28; G10H 3/12
USPC ..... 84/402–410
See application file for complete search history.

(56) References Cited

U.S. PATENT DOCUMENTS 5,808,215 A 9/1998 Kralik et al.
6,555,736 B1 * 4/2003 Delosreyes ..... G10D 13/06 84/402
7,045,695 B1 5/2006 Cohen
2008/0173155 A1 * 7/2008 Fermie ..... G10K 3/00 84/402
2011/0067554 A1 3/2011 Taninbaum

FOREIGN PATENT DOCUMENTS

DE 202009015962 U1 4/2010
DE 102012112285 B3 8/2013
FR 1382900 11/1964
FR 2692396 A1 12/1993
WO 200109005 A1 2/2001
WO 2011109737 A2 9/2011

* cited by examiner

*Primary Examiner* — Kimberly Lockett
(74) *Attorney, Agent, or Firm* — The Webb Law Firm

(57) ABSTRACT

A percussion instrument has a closed cavity (30) in which a multiplicity of sound-producing particles (3) are provided. The cavity (30) is bounded by a lower part forming a shell (20), with an opening which is directed upward in the use position as intended, and by a covering (2; 4) closing the opening. An inner side of the shell (20) forms a rolling surface (26) for the multiplicity of sound-producing particles (3), wherein the dimension of the shell (20) in height is smaller than half the dimension of the shell (20) in one of the widths, and wherein the covering (2; 4) forms an end stop for the sound-producing particles (3) moving on the rolling surface (26) in the direction of the covering (2; 4).

16 Claims, 4 Drawing Sheets

PERCUSSION INSTRUMENT

CROSS-REFERENCE TO RELATED APPLICATION

This application claims priority to European Patent Application No. 14 196 874.3 filed Dec. 9, 2014, the disclosure of which is hereby incorporated in its entirety by reference.

TECHNICAL FIELD

The present invention relates to a sound-producing percussion instrument, in particular a rattle or a shaker.

PRIOR ART

Shakers are known as percussion instruments. They are containers (bodies with cavities) in which balls or other contents are shaken to and fro. There are commercially available shakers in various shapes, sizes and materials. The sound is produced by rolling or grinding the filling in the container. Accents are produced by increased movement pulses, by means of which the filling material is hurled more powerfully against the inner wall of the container. Different rhythm structures can be produced with such accents.

A commercially available shaker is held in the hand. By shaking the shaker (forward-backward or to and fro), an acoustic basic pattern corresponding to the movements is produced. Each sound event corresponds to a movement of the shaker. Therefore, a movement of the shaker is necessary for each sound event.

For example, U.S. Pat. No. 7,045,695 shows such a shaker, wherein said shaker has a shell which is closable with a cover and which is fastened to a flexible handle. The shell has a narrowing end region in which an opening closable by the cover is arranged. The shaker is held by way of the flexible handle and shaken, as a result of which the particles located in the shell are hurled against the shell wall and as a result of which rattling is produced. An accent can be produced only by increased shaking.

US 2008/0173155 discloses a shaker consisting of two disc-shaped elements with an encircling edge, wherein the edge of the one element can be pulled over that of the other element, as a result of which a cavity is formed between the two elements. A multiplicity of sound-producing particles are located in said cavity, as a result of which rattling arises during shaking. The shaker has fastening devices, and therefore the shaker can be attached to instruments, such as a tambourine, hi-hat or the like. An acoustic accent can be produced only by increased shaking.

WO 2011/1109737 shows a shaker having a plurality of channels which are closed at the ends, wherein the channels are arranged in different directions to one another, and wherein sound-producing particles are located in the channels. Different sound events can be produced by shaking the shaker in different directions. During a pivoting circular movement of the shaker, the particles roll in the channels until the particles strike against an end boundary, as a result of which an acoustic accent is produced. The design of such a shaker is complicated.

It is therefore an object of the invention to provide a shaker with which acoustic accents can be produced easily and which is distinguished by a simple structure.

This object is achieved by a percussion instrument with the features of claim 1.

SUMMARY OF THE INVENTION

A percussion instrument according to the invention has a closed cavity in which a multiplicity of sound-producing particles are provided. The cavity is bounded by a lower part forming a shell, with an opening which is directed upward in the use position as intended, and by a covering closing the opening. An inner side of the shell forms a rolling surface for the multiplicity of sound-producing particles. The dimension of the shell in height is smaller than half the dimension of the shell in one of the widths, and the covering forms an end stop for the sound-producing particles moving on the rolling surface in the direction of the covering.

By moving, preferably inclining or pivoting the instrument, the sound-producing particles, for example balls, are moved from the inoperative position thereof in the direction of an edge region of the shell. If the movement is sufficiently powerful, the balls impact against the covering forming the end stop and produce an acoustic accent.

An acoustic event produced by movement is extended by echo-like reverberation effects, wherein the latter arise by the balls continuing to reverberate.

This means a reduction in the play movements for musicians. A continuous carpet of sound or a rhythmic basic pattern can be produced with little movement complexity. In particular, the automatic further resonance permits precise playing of the shaker using the foot which, in contrast to the hand, is less competent in terms of movement.

The covering can consist of a shell which is similar to the shell forming the lower part and which, on assembly, forms a stack with the shell forming the lower part.

By means of the formation of a stack, the number of shells and cavities filled with balls can be increased, which leads to an increase in the sound volume.

Alternatively, different cavities can be filled with different balls in order to bring about a different sound.

It is likewise possible to use different materials for the shell elements in order to produce a different sound.

In a preferred embodiment, the shell is a rotationally symmetrical shell, wherein a rotation axis extends in the direction of the height and is perpendicular to two mutually perpendicular main directions which extend in the direction of the widths.

Such shells can be produced in a simple and cost-effective manner.

In order to increase the number of sounds which can be produced with the instrument, a non-rotationally symmetrical shell shape may be of advantage.

The shell preferably has two mutually perpendicular main directions which extend in the direction of the widths, and the dimension of the shell is greater in a first main direction than the dimension in a second main direction.

Rolling surfaces of differing lengths are produced on the inner side of the shell solely by means of the different dimensions. This leads to the balls, with the same movement, especially the same inclination or pivoting movement needing a different length of time in the one main direction, in order to pass from one side of the shell to the opposite side of the shell, than in the other main direction.

Such a shape makes it possible for the instrument to be used for rapid tempos (shorter rolling surface) or slower tempos (longer rolling surface).

The shell preferably has at least one convexity in one of the main directions. For example, the convexities are channel-shaped depressions. The convexities keep the balls on a defined rolling surface, which prevents the balls from rolling uncontrollably in all directions if the instrument is moved or shaken. The sound which can be produced is more focused and more compact since the balls are concentrated in the convexities. During playing, relatively small deviations in direction of the movements in one of the main directions do not lead to different sounds of the instrument.

In a preferred embodiment, at least two shells are arranged next to each other and are connected to each other by a connecting element and form a shell element. As a result, a plurality of acoustic events can be produced at the same time, which contributes to the richness of sound.

It is optionally possible for differently configured shells to be arranged next to one another in order to produce different sound events.

In addition to the arrangement of two shells next to each other, the arrangement of, for example, three, four or more shells is also conceivable. In the case of the arrangement of three and more shells, the latter can be arranged in a triangle, square, polygon or circle or as desired.

The shells are preferably formed together integrally with the connecting element. This construction permits simple and cost-effective production.

Spacers are preferably arranged between two adjacent shells or shell elements or reinforcements or the baseplate of the stack, said spacers being usable for adjusting the size of the closed cavity located therebetween. The spacers may be inflexible or pliant to a certain degree. With rigid spacers, a predetermined distance can be achieved between two adjacent shell elements. The spacers are preferably made from aluminum since the latter is light and resistant to weathering. Alternatively, the spacers may be composed of rigid plastic.

The sound propagation in the instrument and therefore the sounds which can be produced can be changed by tightening the tensioning elements.

In a preferred embodiment, spacers are arranged between the covering and the shell, shell element or the baseplate located on the opposite side of the stack. Different sounds can be realized by the different configuration of the spacers.

Tensioning means are preferably provided, with which the shells, the shell elements, the reinforcements, the baseplate and the covering can be held together and tuned. Screw or clamping connections, for example, are suitable for this purpose. By tightening the nut or the screw, the contact pressure force against the outmost elements of the stack can be increased and therefore the tension in the instrument can be increased. This leads to a change in the sound which can be produced. Alternatively, tensioning elements can be used, for example, with clamping lever and eccentric. This permits a rapid readjustment from the relaxed state into the tensioned state and back, which permits greater flexibility during playing.

Fastening means are preferably provided, with which the percussion instrument is fastenable to the human body or to an actuating device. The instrument can be played by hand or with the foot. A recess for receiving part of the shin makes it easier to attach the instrument above the ankle. The instrument can be fastened to the foot and/or to the shin with an elastic band which serves as fastening means.

The orientation of the instrument with respect to the longitudinal direction of the foot decides whether slower tempos or more rapid tempos can be played. If the first main axis is parallel to the longitudinal direction of the foot, i.e. the balls roll along the longer rolling surface, slower tempos can be played. Accordingly, the parallel orientation of the second main axis parallel to the longitudinal direction of the foot permits the playing of more rapid tempos.

In a preferred embodiment, the shells or shell elements and/or the covering are made of metal, wood or plastic. Shell elements made of metal or plastic permit production by means of deep drawing or thermoforming, which is advantageous in respect of the outlay on production and the costs. A shell element is preferably thermoformed from a polystyrene film. It is alternatively possible to thermoform other plastics or deep draw steel, aluminum or copper sheets.

The sound-producing particles can be made of metal, wood, plastic or natural material, such as, for example, peas, beans, grains, stones or sand. The sound-producing particles are preferably balls, preferably made of metal. Metal balls roll readily, are highly durable and produce a distinctive sound, and make it possible for the sound which can be played to change only imperceptibly, if at all, over time.

Further embodiments are specified in the dependent claims.

BRIEF DESCRIPTION OF THE DRAWINGS

Preferred embodiments of the invention are described below with reference to the drawings which serve merely for explanation and should not be interpreted as being limiting. In the drawings.

DESCRIPTION OF PREFERRED EMBODIMENTS

Figure 6:
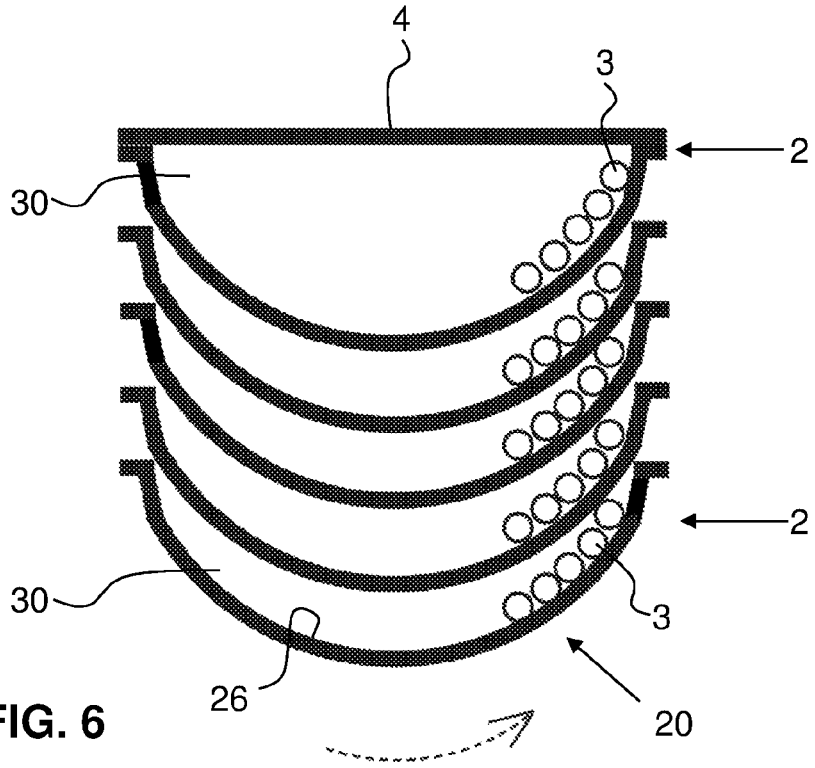
FIG. 6 shows a lateral sectional view through a percussion instrument according to the invention with a stack of shells and a covering.

FIG. 6 shows a lateral sectional view through a percussion instrument according to the invention with a stack of shells 2, a covering 4 and with balls 3 which are provided in cavities 30.

The abovementioned elements form the essence of the instrument. The individual elements will be discussed below first before coming back to the assembly.

Figure 1:
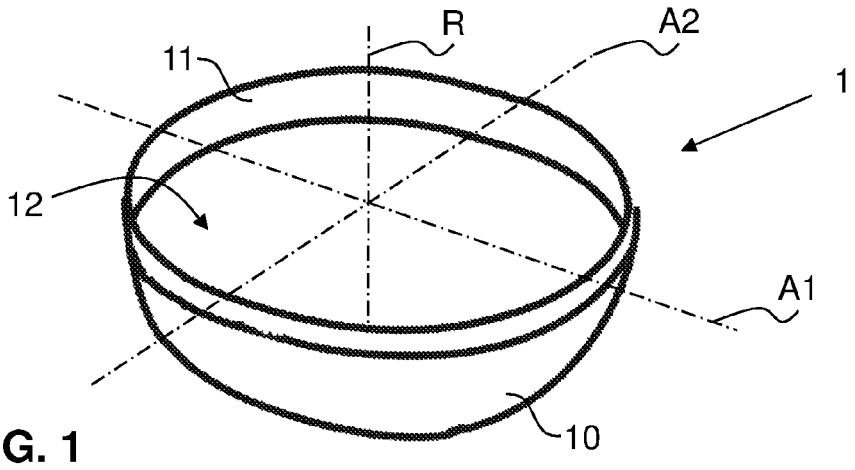
FIG. 1 shows a perspective view of a first shell element of a percussion instrument according to the invention with a shell.

FIG. 1 shows a perspective view of a first shell element 1 of a percussion instrument according to the invention with a shell 10. The shell 10 is a body which is rotationally symmetrical about a rotational axis R, wherein the rotational axis R extends in the direction of the height and is perpendicular to two mutually perpendicular main directions A1, A2 which extend in the direction of the widths.

In the use position as intended, the shell has an upwardly directed opening 12 which is bounded by an upper shell portion 11. The upper shell portion 11 therefore forms an edge of the shell 10.

The edge 11 is formed together integrally with the shell 10. The shell 10 is designed as a spherical segment, from the upper end of which the edge 11 extends upward as a conical segment.

Figure 4:
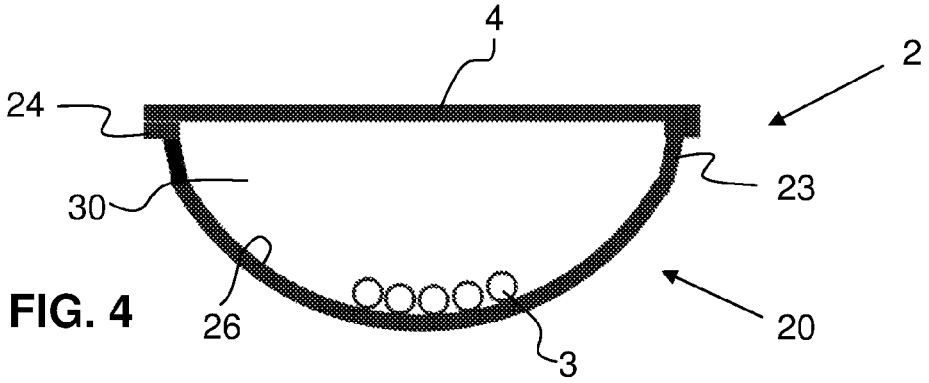
FIG. 4 shows a lateral sectional view through a percussion instrument according to the invention with a shell and a covering.

As in the embodiment shown in FIG. 4, an outwardly directed flange can be formed together integrally with the edge at the upper end of the edge 11 of the embodiment shown in FIG. 1.

Figure 2:
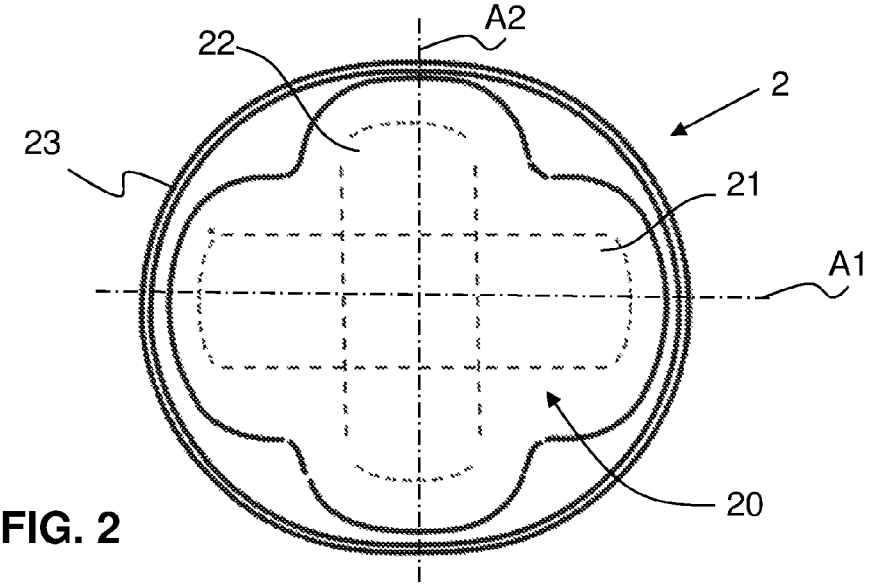
FIG. 2 shows a top view of a second shell element of a percussion instrument according to the invention with a shell.
Figure 3:
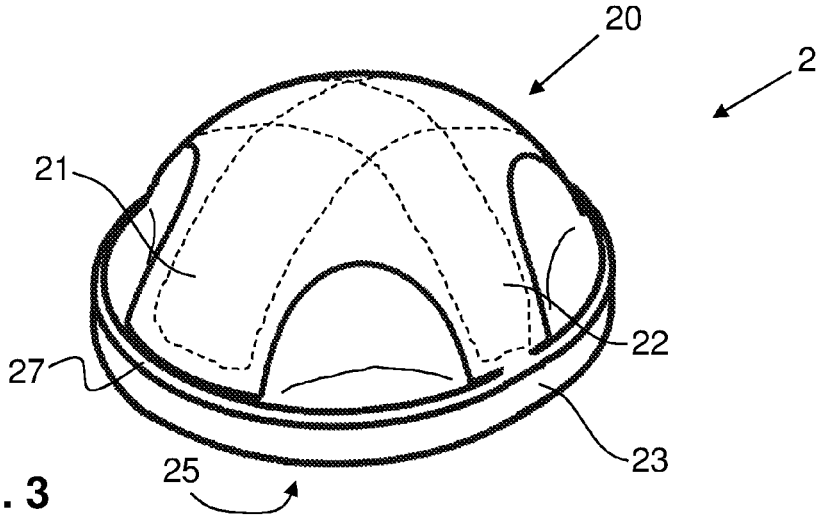
FIG. 3 shows a perspective bottom view of the shell element of FIG. 2.

FIG. 2 shows a top view of a second shell element 2 of a percussion instrument according to the invention with a shell 20, and FIG. 3 shows a perspective bottom view of the shell 2 from FIG. 2.

The shell element 2 has two mutually perpendicular main directions A1, A2 which extend in the direction of the widths, wherein, in this exemplary embodiment, the dimension of the shell 20 is greater in a first main direction A1 than in a second main direction A2 perpendicular thereto.

The shell 20 has a first convexity 21 in the first main direction A1 and a second convexity 22 in the second main direction A2. The convexities 21, 22 have the shape of channel-shaped depressions. The inner sides of the convexities 21, 22 form rolling surfaces for sound-producing particles which can be placed into the shell 20. The different dimensions of the shell in the two main directions means that the first convexity 21 has a longer rolling surface than the second convexity 22.

Sound-producing particles which roll in the first convexity 21 therefore require a shorter time in order, with the same lateral inclination of the shell, to pass in the movement from the one side of the convexity onto the opposite side of the convexity in the first main direction A1, as sound-producing particles which roll in the second main direction A2 in the second convexity 22.

The shell 20 has an upper opening 25 which is bounded by an edge 23 substantially extending upward.

The edge 23 is formed together integrally with the shell 20. In contrast to the embodiment illustrated in FIG. 1, the edge 23 is formed offset outward with respect to the shell and forms a step 27.

The edge 23 is preferably slightly inclined, and therefore the inside width of the opening 25 within the edge 23 increases upward.

FIG. 4 shows a lateral sectional view through a percussion instrument according to the invention with a shell 10, 20 and a covering 4. This involves, for example, a lateral sectional view of the first or second shell element 1, 2 with a covering 4, which closes the opening 12, 25, in one of the main directions A1, A2.

The shell element 2, with or without convexities 21, 22, has a curved shell 20 with an upper edge 23 and a flange 24 formed integrally with the upper edge 23. The inner side of the shell 20 forms a rolling surface 26 for sound-producing particles 3.

The edge 23 has a different inclination than the shell adjoining said edge, and therefore a kink forms between the shell and the edge. The edge is inclined in such a manner that the inside width of the opening 25, which is bounded by the edge, widens upward within the edge.

The flange 24 extends from the edge 23 laterally outward in all directions and forms a support surface for the covering 4 and the spacers 7, 70. If the covering is placed onto the shell element, the two elements bound a closed cavity 30 in which sound-producing particles 3, for example balls, are provided.

The covering is fastened to the shell element 2, preferably to the flange 24, with fastening means (not illustrated in FIG. 4). The flange 24 has the additional advantage that the shell element 2 can be inserted, for example, into a holder (not illustrated). The shell element together with the covering can be fixedly connected to the holder.

Figure 5:
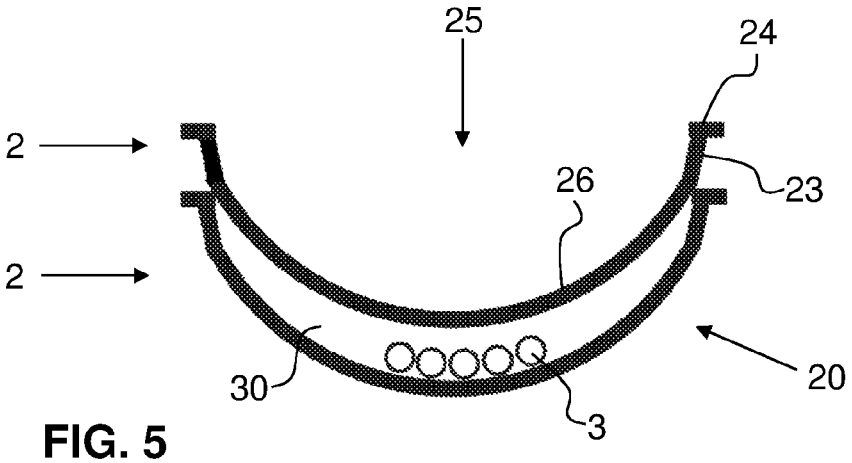
FIG. 5 shows a lateral sectional view through a percussion instrument according to the invention with a shell and a further shell as the covering.

FIG. 5 shows a lateral sectional view through a percussion instrument according to the invention with a shell 20 and a further shell 20 as the covering.

In contrast to the embodiment of FIG. 4, a further shell element 2 forms the covering of the opening 25 of the shell element 2 located therebelow. The two shell elements form a stack, and the cavity 30 is bounded by the lower shell element 2, on the one hand, and by the upper shell element 2, on the other hand.

The inclined configuration of the edge 23 makes it possible for the shell elements 2 to be easily and simply stacked on one another since the shape of the edge brings about a centering of the shell elements on and in one another.

As in the embodiment of FIG. 4, balls 3 are provided in the cavity 30.

The two shell elements can be connected to each other with tensioning or fastening means (not illustrated). In addition, spacers (not illustrated) can be arranged between the shell elements in order to bring about a predetermined size of the cavity.

FIG. 6 shows a lateral sectional view through a percussion instrument according to the invention with a stack of shells 20 or shell elements 2 and a covering 4. This constitutes a combination of the general principles of the embodiments illustrated in FIGS. 4 and 5, namely the closing of the shell opening by a covering and the stacking of shell elements.

A stack having five shell elements 2 is illustrated, wherein the opening in the uppermost shell element is closed with a covering 4.

Two adjacent shell elements 2, or the uppermost shell element 2 of the stack, and the covering 4 bound a respectively closed cavity 30 in which a multiplicity of balls 3 are provided.

As in the embodiment of FIG. 5, the shell elements can be inserted individually or as a stack into a holder.

Spacers can be arranged between the shell elements, and the shell elements and the covering can be held together with tensioning means.

Figure 7:
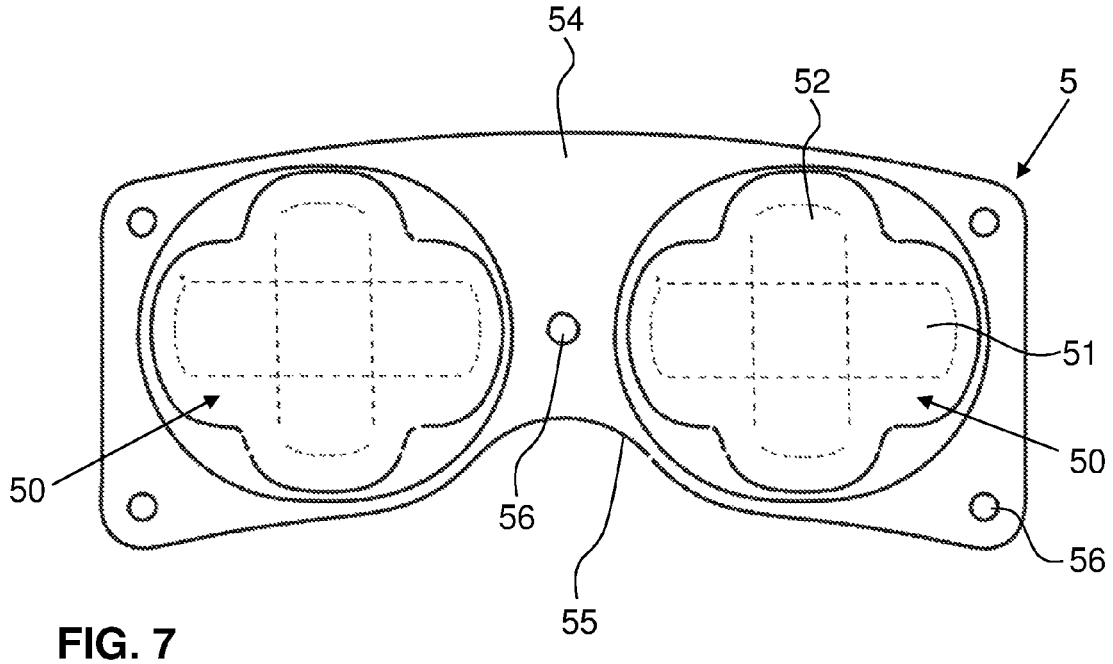
FIG. 7 shows a top view of a third shell element of a percussion instrument according to the invention with two shells.

FIG. 7 shows a top view of a third shell element 5 of a percussion instrument according to the invention with two shells 50 which are arranged laterally next to each other.

The configuration of the shells 50, as illustrated, resembles the shell illustrated in FIG. 2. Alternatively, it may resemble the shell from FIG. 1. The shells 50 have first convexities 51, which extend in the direction of the first main axes A1, and have two second convexities 52, which extend in the direction of the second main axes A2.

The two shells are arranged next to each other in such a manner that the first main axis A1 of the one shell is colinear to the first main axis A1 of the other shell.

The flanges of the two shells 50 are formed together integrally with each other and form a flange plate 54. Alternatively, the shells can have a flange and can be inserted into a plate.

The flange plate 54 has a recess 55 which is designed in such a manner that, for example, an arm or a leg of a person playing the percussion instrument can be at least partially accommodated therein.

The flange plate 54 furthermore has bores 56 with which tensioning, fastening or centering elements can be accommodated.

Figure 8:
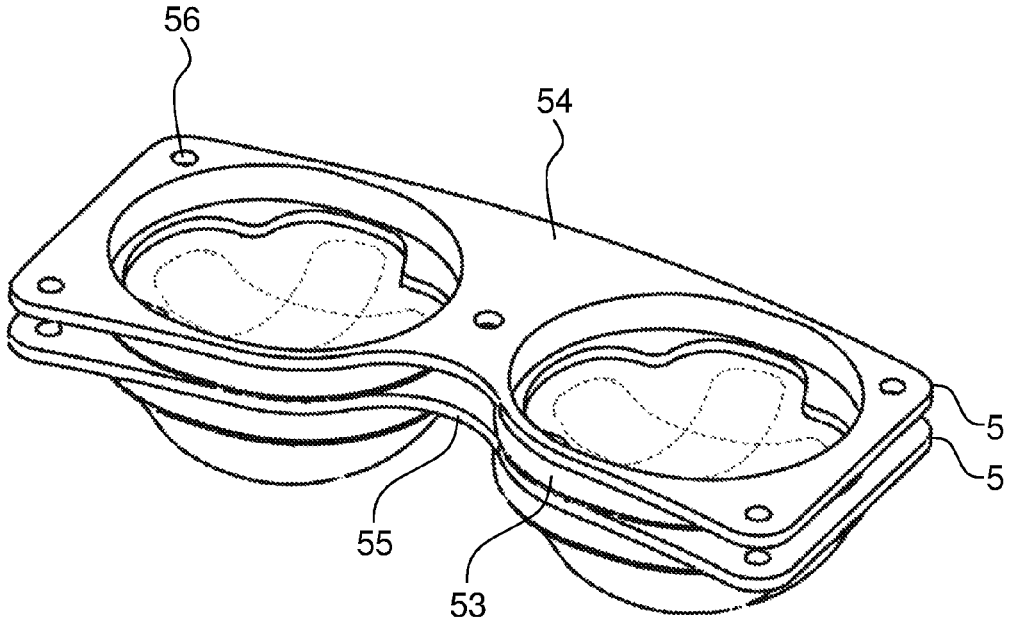
FIG. 8 shows a perspective view of a percussion instrument according to the invention with a stack of two shell elements from FIG. 7.

FIG. 8 shows a perspective view of a percussion instrument according to the invention with a stack of two shell elements from FIG. 7. The edges 53 of the shells 50 serve as centering means.

The shells 50, like the shells 20 illustrated in FIG. 3, have an edge 23, 53 which forms a step outward with respect to the shell. Said step forms a stop for the stacking of the individual shell elements.

The stacked shell elements 5 have an identical orientation, as a result of which the recesses 55 and bores 56 of said shell elements are oriented with one another.

Figure 9:
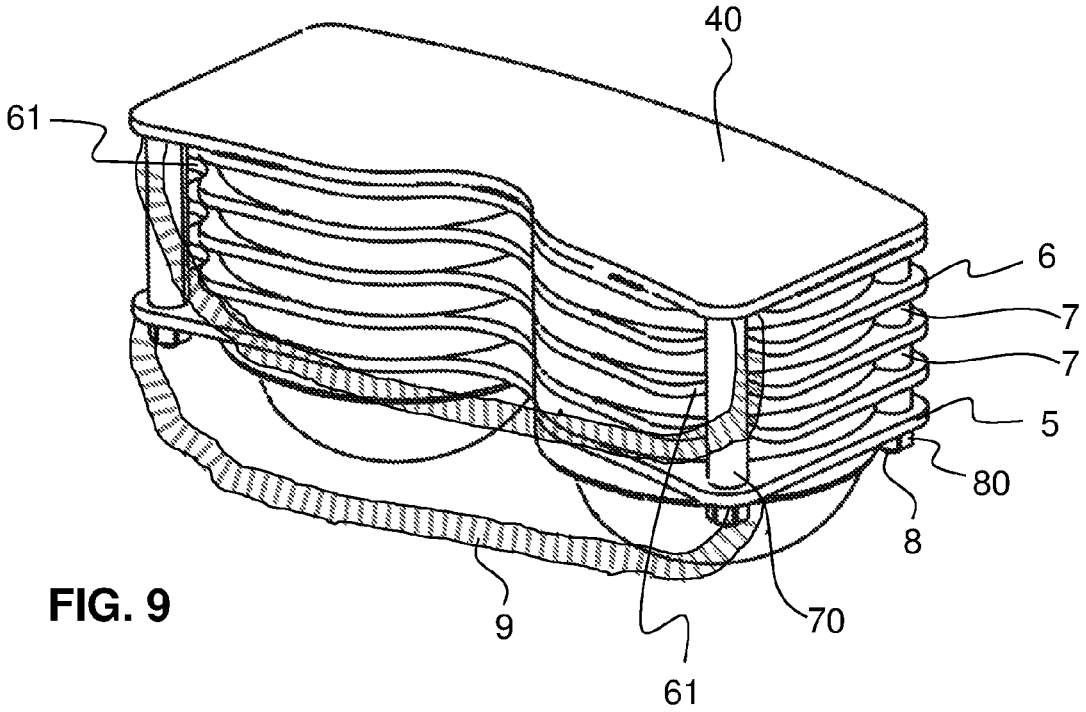
FIG. 9 shows a perspective view of a percussion instrument according to the invention with a stack of fourth shell elements, a covering, clamping and fastening means.

FIG. 9 shows a perspective view of a percussion instrument according to the invention with a stack of third and fourth shell elements 5, 6, a covering 40 and clamping and fastening means 7, 70, 8, 80, 9.

In contrast to the shell elements 5 illustrated in FIGS. 7 and 8, the fourth shell elements 6 have recesses 61 in which spacers 70 are accommodated in the assembly. This makes it possible for the distance of the lowermost shell element 5 from the covering 40 to be adjustable with an integrally formed spacer 70. In this embodiment, the spacers and the covering are made of aluminum. However, alternative materials, such as steel and plastic, are also possible.

Alternatively or additionally, individual spacers 7 are arranged between the shell elements 5, 6. The spacers 7, 70 are configured in such a manner that they can accommodate tensioning elements 8.

A threaded rod 8 is illustrated which is fastened to the covering 40 and extends over the entire height of the stack, through the bores provided for this purpose in the lowermost shell element 5 of the stack and beyond. A screw nut with which the stack can be compressed is provided on that side of the lowermost shell element of the stack which is opposite the covering.

Alternatively, bores into which a tensioning element can be introduced may be present in the covering 40. For example, use can be made of a screw which projects from the covering as far as the lowermost shell element located on the opposite side of the stack, and beyond said shell element.

An elastic band 9 is fastened to the instrument in order to enable the instrument to be fastened to the leg, above the foot. Alternatively, a plurality of elastic bands or adjustable straps can be used.

Figure 10:
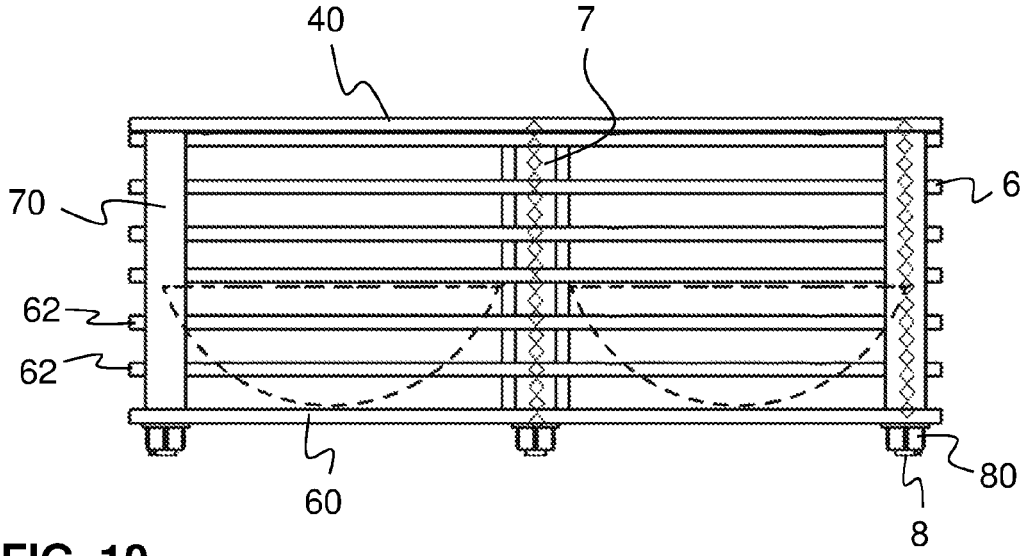
FIG. 10 shows a side view of a percussion instrument according to the invention with reinforcements and baseplate.

FIG. 10 shows a side view of a percussion instrument according to the invention with reinforcements 62 and a baseplate 60. The reinforcements have the same dimensions as the shell elements, but do not have any shells, but rather recesses into which the shells of the shell element located above project in the assembly. The recesses differ depending on the position of the reinforcement with respect to the next shell element.

Furthermore, the instrument is provided with a baseplate 60 which constitutes a lower end of the instrument. Spacers are provided between the shell elements and the reinforcements and the baseplate. The stack of shell elements is clamped between the covering 40 and the baseplate 60 with tensioning means 8, 80.

LIST OF REFERENCE NUMBERS

1 first shell element
10 shell
11 edge
12 opening
2 second shell element
20 shell
21 first convexity
22 second convexity
23 edge
24 flange
25 opening
26 rolling surface
27 step
3 ball
30 closed cavity
31 cavity
4 covering
40 covering plate
5 third shell element
50 shell
51 first convexity
52 second convexity
53 edge
54 flange plate
55 recess
56 bore
6 fourth shell element
60 baseplate
61 recess
62 reinforcement
7 spacer
70 spacer
8 threaded rod
80 nut
9 elastic band

The invention claimed is:

1. A percussion instrument with a closed cavity in which a multiplicity of sound-producing particles are provided, wherein the cavity is bounded by a lower part forming a shell, with an opening which is directed upward in the use position as intended, and by a covering closing the opening, wherein an inner side of the shell forms a rolling surface for the multiplicity of sound-producing particles, wherein the dimension of the shell in height is smaller than half the dimension of the shell in one of the widths, and in that the covering forms an end stop for the sound-producing particles moving on the rolling surface in the direction of the covering, wherein the covering consists of a shell which is similar to the shell forming the lower part and which, on assembly with the shell forming the lower part, forms a stack.

2. The percussion instrument as claimed in claim 1, wherein the shell is a rotationally symmetrical shell, wherein a rotation axis extends in the direction of the height and is perpendicular to two mutually perpendicular main directions which extend in the direction of the widths.

3. The percussion instrument as claimed in claim 1, wherein the shell has two mutually perpendicular main directions which extend in the direction of the widths, and wherein the dimension of the shell is greater in a first main direction than the dimension in a second main direction.

4. The percussion instrument as claimed in claim 2, wherein the shell has at least one convexity in one of the main directions.

5. The percussion instrument as claimed in claim 3, wherein the shell has at least one convexity in one of the main directions.

6. The percussion instrument as claimed in claim 1, wherein at least two shells are arranged next to each other and are connected to each other by a connecting element and form a shell element.

7. The percussion instrument as claimed in claim 6, wherein the shells are formed together integrally with the connecting element.

8. The percussion instrument as claimed in claim 1, wherein spacers are arranged between two adjacent shells or shell elements of the stack, said spacers being usable for adjusting the size of the closed cavity located therebetween.

9. The percussion instrument as claimed in claim 1, wherein spacers are arranged between the covering and the shell or shell element located on the opposite side of the stack, or a baseplate located on the opposite side of the stack.

10. The percussion instrument as claimed in claim 1, wherein tensioning means are provided, with which the shells or the shell elements and the covering are held together, and with which the percussion instrument can be tuned.

11. The percussion instrument as claimed in claim 1, wherein fastening means are provided, with which the percussion instrument is fastenable to the human body or to an actuating device.

12. The percussion instrument as claimed in claim 1, wherein the shells or shell elements are made of metal, wood or plastic.

13. The percussion instrument as claimed in claim 1, wherein the covering is made of metal, wood or plastic.

14. The percussion instrument as claimed in claim 1, wherein the sound-producing particles are made of a natural material from the group comprising peas, beans, grains, stones or sand.

15. The percussion instrument as claimed in claim 1, wherein the sound-producing particles are made of metal, wood or plastic.

16. The percussion instrument as claimed in claim 1, wherein the sound-producing particles are balls.

* * * * *